US011988044B2

(12) United States Patent
Dimitroff

(10) Patent No.: US 11,988,044 B2
(45) Date of Patent: May 21, 2024

(54) EXCAVATION BORING AND SHORING METHOD AND EQUIPMENT

(71) Applicant: Ted R. Dimitroff, Columbia, MO (US)

(72) Inventor: Ted R. Dimitroff, Columbia, MO (US)

( * ) Notice: Subject to any disclaimer, the term of this patent is extended or adjusted under 35 U.S.C. 154(b) by 0 days.

(21) Appl. No.: 17/932,797

(22) Filed: Sep. 16, 2022

(65) Prior Publication Data

US 2024/0093555 A1 Mar. 21, 2024

(51) Int. Cl.
*E21B 10/26* (2006.01)
*E21B 33/14* (2006.01)
*E21D 5/01* (2006.01)

(52) U.S. Cl.
CPC ..... *E21B 10/26* (2013.01); *E21B 33/14* (2013.01); *E21D 5/01* (2013.01)

(58) Field of Classification Search
CPC ..... E21B 10/26; E21B 33/14; E21D 5/01
See application file for complete search history.

(56) References Cited

U.S. PATENT DOCUMENTS 5,017,016 A 5/1991 Nasu
5,167,719 A 12/1992 Tamaki
5,176,212 A * 1/1993 Tandberg ..... E21B 10/567 175/336
5,823,276 A * 10/1998 Beck, III ..... E02D 5/36 175/405.1
8,926,229 B1 * 1/2015 Clair ..... E02D 17/08 405/282
9,255,476 B2 * 2/2016 Mancini ..... E21D 1/00
2006/0196699 A1 * 9/2006 Estes ..... E21B 10/04 175/398
2011/0299941 A1 * 12/2011 Dimitroff ..... E02D 19/16 405/272

(Continued)

FOREIGN PATENT DOCUMENTS

DE 3735008 A1 5/1989
DE 9115823 U1 2/1992
DE 9207366 U1 8/1992

(Continued)

OTHER PUBLICATIONS

Das, Madhurima, "Cylinder: Shape, Definition, Types, Formulas, Properties—Embibe" Oct. 26, 2023, www.embibe.com/exams/cylinder. (Year: 2023).*

(Continued)

*Primary Examiner* — Caroline N Butcher
(74) *Attorney, Agent, or Firm* — McKee, Voorhees & Sease, PLC

(57) ABSTRACT

A reaming tool forms a hole in the ground with a sidewall and a floor, and a deepened channel around the perimeter of the floor adjacent to sidewall. Fluid is provided during excavation to form a slurry to hold the sidewall and prevent cave-in of material into the hole. After the hole reaches a desired depth, the reaming tool is removed, and a shoring wall is inserted into the hole through the slurry and seated in the perimeter edge channel. The shoring wall includes vertical tubes for connection to a dewatering machine. Then, the slurry can be vacuumed from the hole, while the dewatering machine keeps the empty hole as dry as possible. Extending the shoring wall into the channel beyond the floor of the hole helps seal flow of water from entering the hole.

15 Claims, 5 Drawing Sheets

(56) References Cited

U.S. PATENT DOCUMENTS

| | | | | |
|---|---|---|---|---|
| 2012/0219363 | A1* | 8/2012 | Dimitroff | F16L 55/1658<br>405/184.1 |
| 2013/0228382 | A1* | 9/2013 | Sauvageau | E21B 10/04<br>175/408 |

FOREIGN PATENT DOCUMENTS

| | | | |
|---|---|---|---|
| DE | 4142222 | A1 | 6/1993 |
| DE | 4109691 | C2 | 1/1994 |
| EP | 377087 | A2 | 7/1990 |
| EP | 351440 | B1 | 12/1992 |
| JP | 2705803 | B2 | 1/1998 |
| JP | 4147237 | B2 | 9/2008 |

OTHER PUBLICATIONS

Welker et al., "Evaluation of a Commercial Vacuum System for the Removal of Asbestos," EPA Research and Development, May 1980, EPA-600/2-80-088, 85 pages.

* cited by examiner

EXCAVATION BORING AND SHORING METHOD AND EQUIPMENT

TECHNICAL FIELD

The invention relates to equipment and methodology for creating and maintaining an excavated hole in the ground.

BACKGROUND

The excavation of material to form a hole or pit in the ground, such as to provide an in-the-ground work area, can be done in many ways. Depending on soil conditions, the excavated hole may require shoring to prevent material from caving into the open hole and to maintain the sidewall of the hole. For example, if the soil is dry and loose, or very wet, the hole sidewall will not stand on its own, such that shoring is required to hold the sidewall in place. Some existing methods require the ground or soil to be dewatered prior to excavation. In other instances, the shoring structure must be installed as the soil is excavated, until the hole or pit reaches a desired depth. These current methods have problems with the soil, sand or water falling into the excavated area. Another alternative method, though expensive, is to drive sheet piling steel into the ground before excavation, and then excavating the soil or sand.

Accordingly, a primary objective of the present invention is the provision of a method for improved excavation and shoring of a hole or pit in the ground.

Another objective of the present invention is the provision of equipment to simplify the excavation and shoring of a hole in the ground.

A further objective of the present invention is the provision of an excavation reaming tool to form a pit in the ground having a deeper perimeter edge than the floor of the pit.

Still another objective of the present invention is the provision of a shoring structure having tubes for connection to a dewatering machine.

Another objective of the present invention is the provision of a method of excavating a hole with a reaming tool and the use of slurry to maintain the sidewall of the excavated hole, prior to installation of a shoring ring.

These and other objectives will become apparent from the following description of the invention.

SUMMARY

The method of the present invention for excavating and shoring a hole in the ground utilizes an innovative reaming tool and shoring ring to simplify the process and avoid problems of prior art processes for excavation and shoring.

The method includes drilling a hole in the ground having a sidewall, a floor at a first depth, and the perimeter edge around the hole at a second depth deeper than the floor. Water is provided during excavation so as to create a slurry to help hold back the sidewall as the hole is formed. Then, a shoring ring is installed in the excavated hole so as to sit downwardly into the deepened perimeter edge. The slurry can then be vacuumed out of the hole. The shoring ring includes internal vertical tubes, which can be connected to a conventional dewatering machine so to further suck moisture out of the excavated hole and from the surrounding soil.

The reaming tool for excavating the hole is generally circular in shape and is driven by a driveshaft which rotates and forces the tool downwardly as cutting tips on the reamer head bore through the soil material. The perimeter edge of the reaming head includes legs with cutting tips to form the deepened perimeter edge of the hole. The shoring ring includes inner and outer walls, with a plurality of vertical tubes residing between the inner and outer walls. The upper ends of the tubes are adapted to be connected to hoses of a dewatering machine.

DETAILED DESCRIPTION

Figure 2:
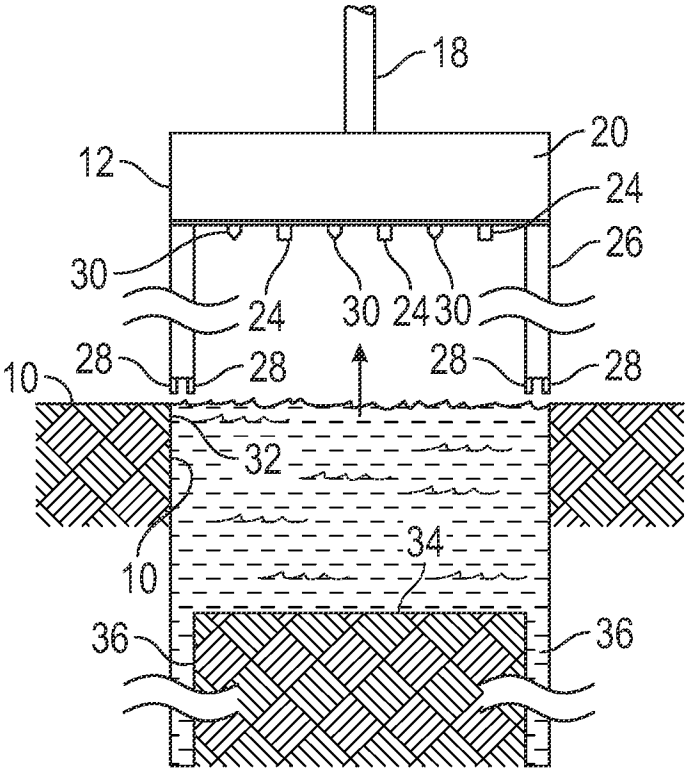
FIG. 2 is a schematic view showing the reamer tool removed from the ground after the hole is formed.
Figure 1:
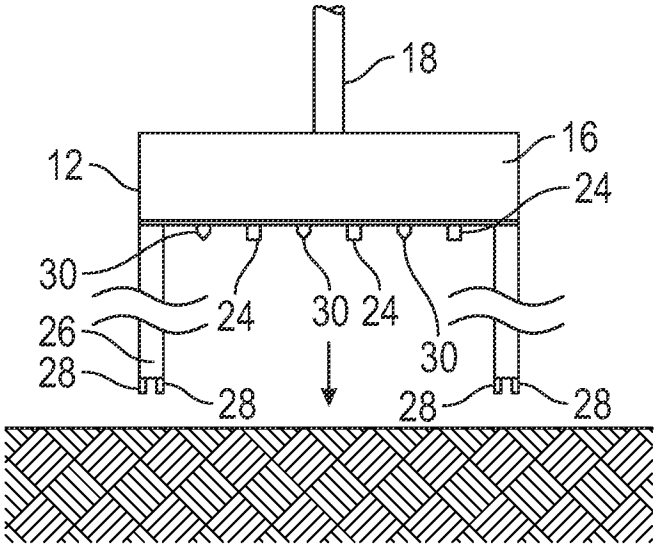
FIG. 1 is a schematic view showing the reamer tool positioned above the ground in preparation for excavation.

The method of the present invention for forming a hole or pit 10 in the ground is illustrated in FIGS. 1-4. The equipment used to form and maintain the hole 10 is shown in FIGS. 5-8. The equipment includes a reaming tool 12 and a shoring tool 14.

The reaming tool 12 includes a drill head 16 connected to a shaft 18. The head 16 includes an outer perimeter ring 20 with cross bars or braces 22 extending across the ring 20. A plurality of cutting tips 24 made of carbide or other hard material is provided on the bottom surface of the head 16, such as on the cross bars 22. A plurality of legs 26 extend downwardly from the perimeter of the ring 20 and have cutting tips 28 on the bottom of the legs. Alternatively, the perimeter 20 of the reamer head can extend below the cross bars 22, without the legs 26, such that the cutting tips 28 reside below the cutting tips 24.

The shaft 18 is adapted to be connected to a machine to rotate and drive the head 16 downwardly into the soil so that the cutters 24, 28 grind the soil. Fluid nozzles or ports 30 are provided on the head 16 to deliver water or other cutting fluid to the soil as the head 16 is rotated, so as to create a slurry with the ground soil. The nozzles 30 can be mounted on the head 16 at any convenient location, such as on the braces 22, and connected to an above-ground fluid source. The nozzles 30 are connected by one or more hoses extending through or along the shaft 18 to a fluid source above the ground. As the head 16 is forced downwardly, and the soil is ground by the cutters 24, 28, the slurry helps maintain the sidewall 32 of the hole 10. The cutters 24 form a floor 35 of the hole 10 at a desired depth. The cutters 28 form a deepened channel or perimeter edge 36 around the floor 34 adjacent to sidewall 32 of the hole 10. After the hole 10 reaches the desired depth, the reaming tool 12 is removed, so that the shoring tool 14 can be inserted into the hole 10.

In the preferred embodiment, the shoring tool 14 includes an inner wall 38 and an outer wall 40, which preferably are arranged concentric to another so as to form a gap 42 between the walls 38, 40. A plurality of tubes 44 extend within the gap or space 42 between the upper and lower ends of the walls 38, 40. Preferably, the tubes 44 extend vertically.

The tubes 44 are open at their upper and lower ends. The upper ends of the tubes 44 are adapted to be connected to hoses of a dewatering machine, using any convenient coupling means, such as threads, or quick coupler attachment. The dewatering machine is conventional.

In an alternative embodiment, the shoring ring can have a single wall to engage the sidewall of the hole, with the vertical tubes attached or mounted on the inside surface of the single wall.

Figure 4:
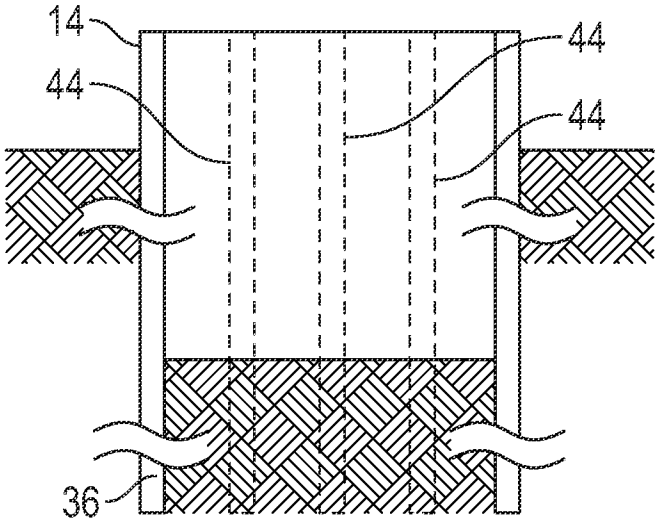
FIG. 4 is a schematic view showing the shoring ring installed in the excavated hole.
Figure 3:
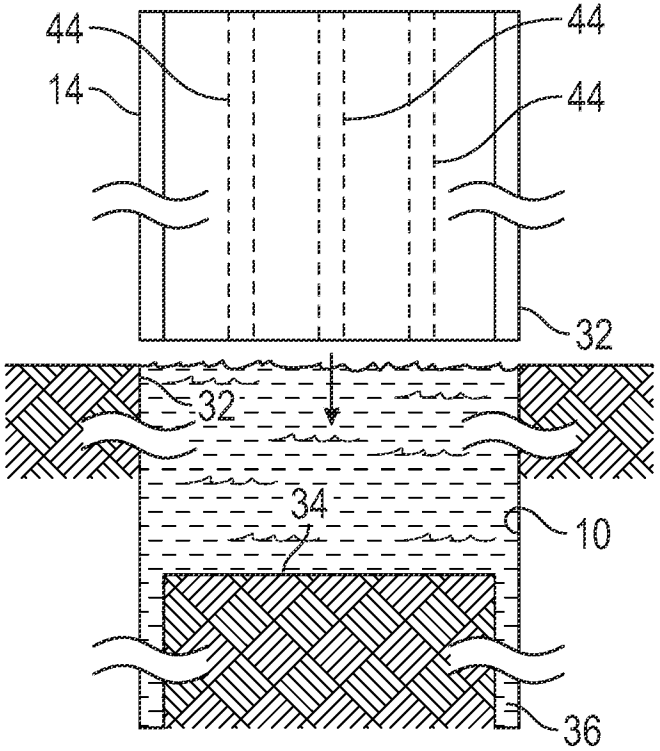
FIG. 3 is a schematic view showing the shoring ring positioned above the hole, prior to installation of the ring.
Figure 5:
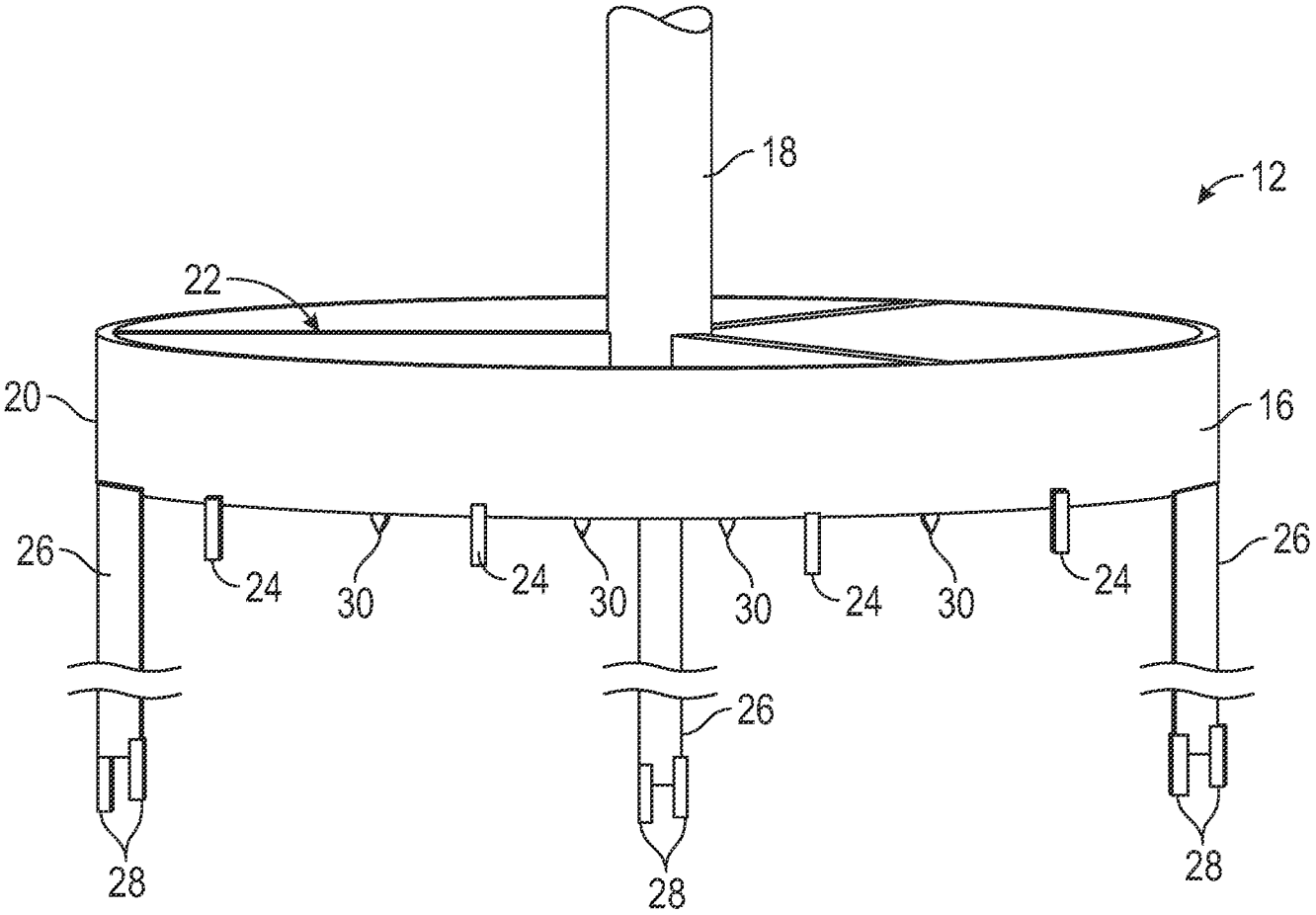
FIG. 5 is a perspective view of the reamer tool of the present invention.
Figure 6:
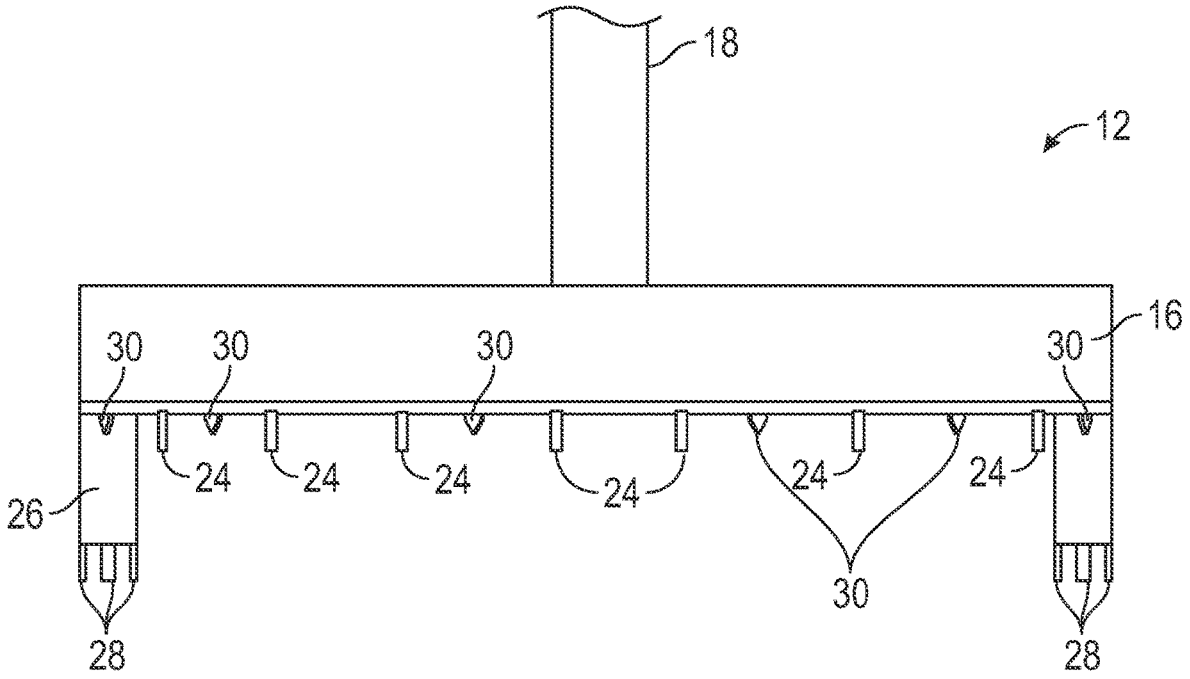
FIG. 6 is a side elevation view of the reamer tool.
Figure 8:
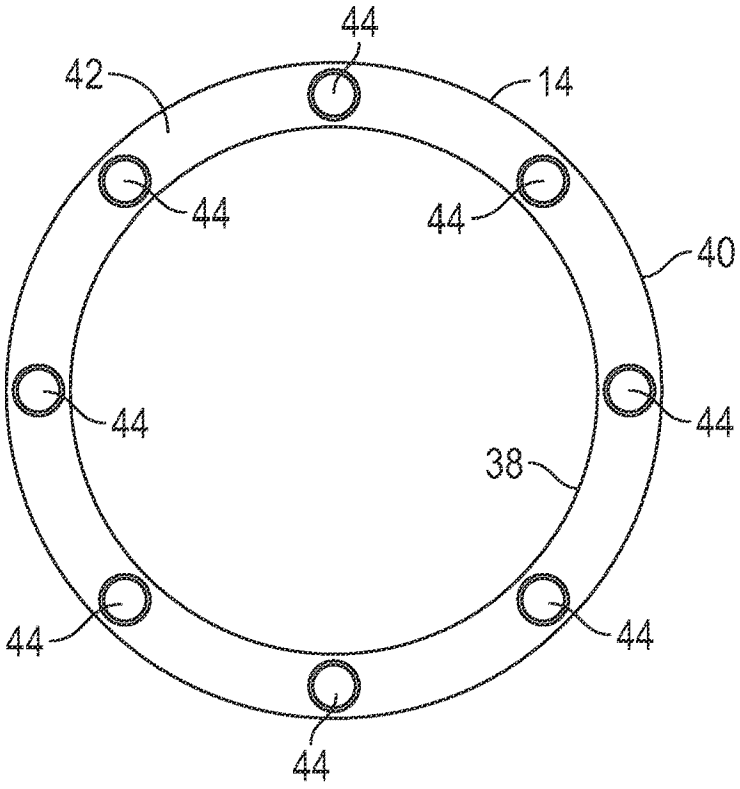
FIG. 8 is a top plane view of the shoring ring shown in FIG. 7.
Figure 7:
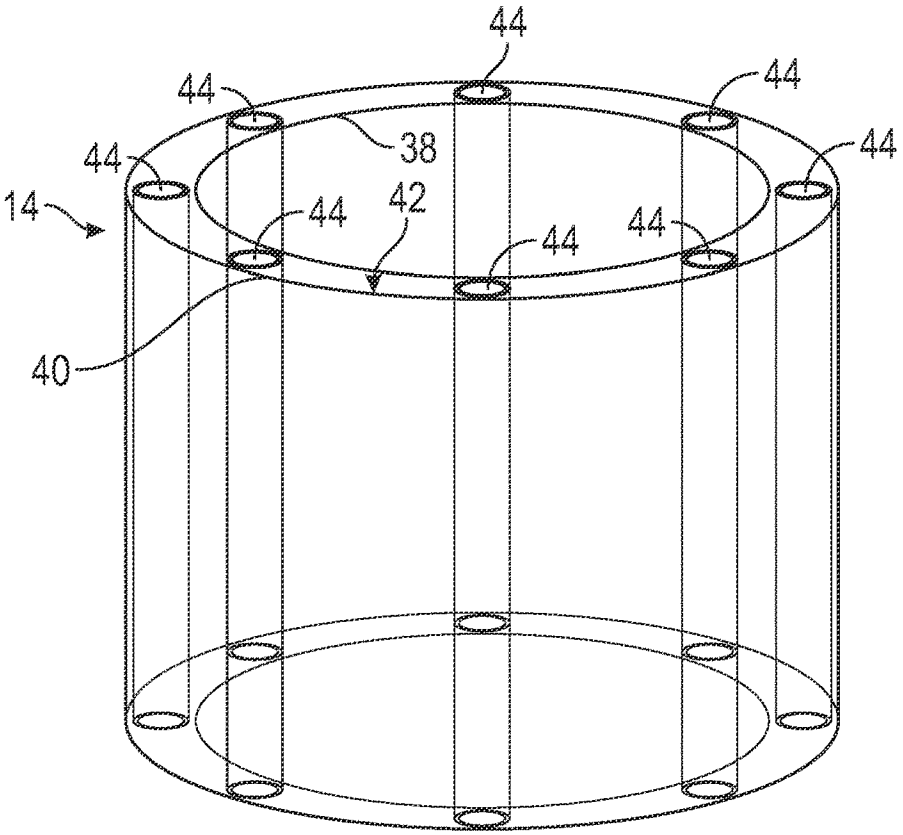
FIG. 7 is a perspective view of the shoring ring of the present invention.

After the hole 10 is formed and the reaming tool 12 is removed, the shoring tool or ring 14 can be forced downwardly through the slurry in the hole 10 until the bottom edge of the walls 38, 40 is seated in the bottom of the channel 36. The upper end of the walls 38, 40 may extend above the surrounding surface of the ground, as seen in FIG. 4. Thus, the shoring tool 14 will retain the sidewall 32 of the hole 10 and prevent cave-in of soil into the hole. After the shoring tool 14 is installed, the slurry material can be vacuumed or removed by other means from the hole, and the dewatering machine can be connected to the tubes 44 to remove additional water seeping from the soil into the hole 10.

Thus, the hole can be formed and maintained in a relatively dry condition so that workers and equipment can be lowered into the hole for whatever work is being performed. By extending the shoring ring 14 beyond the floor 34 of the hole 10, the shoring ring helps seal the flow of water onto the floor 34.

The "invention" is not intended to refer to any single embodiment of the particular invention but encompass all possible embodiments as described in the specification and the claims. The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

What is claimed is:

1. A method of forming and shoring a pit in the ground, comprising:

drilling a hole downwardly into the ground soil, with the hole having a sidewall, a floor at a first depth below a surface of the ground surrounding the hole, and a perimeter channel around the hole at a second depth deeper than the first depth;

soil above the floor being removed during the drilling step;

retaining the sidewall of the hole with fluid pressure from water added to the hole during drilling;

the perimeter channel having spaced apart upright parallel inner and outer walls, and a bottom wall extending perpendicularly between the inner and outer walls; and installing a shoring ring into the hole, the shoring ring having a lower end residing in the perimeter channel.

2. The method of claim 1 wherein the water forms a slurry with soil drilled from the ground.

3. The method of claim 2 wherein the slurry is removed from the hole after the shoring ring is installed.

4. The method of claim 1 wherein the shoring ring is adjacent the outer sidewall of the channel.

5. The method of claim 1 wherein the floor has a first diameter, and the shoring ring has a second diameter greater than the first diameter to fit within the channel.

6. The method of claim 1 further comprising connecting tubes from a dewatering machine to tubes on the shoring ring to remove water from the pit.

7. The method of claim 1 wherein the drilling utilizes two sets of cutting tips, with each set residing at different elevations relative to one another.

8. The method of claim 7 wherein the first set of cutting tips forms the floor and the second set of cutting tips forms the perimeter channel.

9. A method of creating and shoring a work hole in the ground, comprising:

excavating soil from the ground to form a hole having a sidewall and with a bottom defining a floor below ground level with a perimeter edge, and to form a channel extending around the perimeter edge of the floor and below the floor;

the floor and the channel being formed using a single drilling bit;

supplying water to the hole during excavation to retain the soil in the sidewall; and then installing a shoring ring into the hole, the shoring ring having a lower end residing in the channel.

10. The method of claim 9 wherein the excavation is done by drilling.

11. The method of claim 9 further comprising vacuuming the water from the hole after the shoring ring is installed.

12. The method of claim 9 wherein the shoring ring is adjacent the sidewall of the hole.

13. The method of claim 9 wherein the floor has a first diameter, and the shoring ring has a second diameter greater than the first diameter to fit within the hole adjacent the sidewall.

14. The method of claim 9 further comprising connecting tubes from a dewatering machine to tubes on the shoring ring to remove water from the hole.

15. The method of claim 9 wherein the floor is formed by first cutting tips on a drill, and the channel is formed by second cutting tips on the drill.

* * * * *